US011772392B2

(12) United States Patent
Yoshida et al.

(10) Patent No.: US 11,772,392 B2
(45) Date of Patent: Oct. 3, 2023

(54) BASE MATERIAL PROCESSING APPARATUS AND DETECTION METHOD

(71) Applicant: SCREEN HOLDINGS CO., LTD., Kyoto (JP)

(72) Inventors: Mitsuhiro Yoshida, Kyoto (JP); Takaharu Yamamoto, Kyoto (JP); Kazuki Fukui, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 203 days.

(21) Appl. No.: 17/425,273

(22) PCT Filed: Feb. 25, 2020

(86) PCT No.: PCT/JP2020/007304
§ 371 (c)(1),
(2) Date: Jul. 22, 2021

(87) PCT Pub. No.: WO2020/195445
PCT Pub. Date: Oct. 1, 2020

(65) Prior Publication Data

US 2022/0118777 A1 Apr. 21, 2022

(30) Foreign Application Priority Data

Mar. 27, 2019 (JP) ..... 2019-060170

(51) Int. Cl.
*B41J 11/00* (2006.01)
*B41J 11/42* (2006.01)

(52) U.S. Cl.
CPC ..... *B41J 11/0095* (2013.01); *B41J 11/42* (2013.01)

(58) Field of Classification Search
CPC ..... B41J 15/04; B41J 11/0095; B41J 11/42; B41J 11/04; B41J 11/46; B41J 29/393; B41J 29/38
See application file for complete search history.

(56) References Cited

U.S. PATENT DOCUMENTS

2003/0116042 A1 6/2003 Ohba et al.
2008/0122889 A1 5/2008 Naoi et al.
(Continued)

FOREIGN PATENT DOCUMENTS

JP 2003-182896 A 7/2003
JP 2006-091384 A 4/2006
(Continued)

OTHER PUBLICATIONS

International Search Report issued in corresponding International Patent Application No. PCT/JP2020/007304, dated Apr. 14, 2020, with English translation.

*Primary Examiner* — Jannelle M Lebron
(74) *Attorney, Agent, or Firm* — McDermott Will & Emery LLP

(57) ABSTRACT

A base material processing apparatus includes a first detector, a second detector, and an arithmetic unit. The first detector intermittently detects the position of the edge of the base material in the width direction at a first detection position to acquire a first detection result (Ra). The second detector intermittently detects the position of the edge of the base material in the width direction at a second detection position located downstream of the first detection position to acquire a second detection result (Rb). The arithmetic unit calculates a transport error of the base material by comparison between the first detection result (Ra) and the second detection result (Rb). The controller changes detection timing of at least one of the first detector and the second detector.

14 Claims, 14 Drawing Sheets

(56) References Cited

U.S. PATENT DOCUMENTS

| | | | | |
|---|---|---|---|---|
| 2015/0009256 | A1* | 1/2015 | Bildstein | B41J 15/046 347/16 |
| 2016/0075155 | A1 | 3/2016 | Fukui et al. | |
| 2016/0121627 | A1 | 5/2016 | Yoshida et al. | |

FOREIGN PATENT DOCUMENTS

| | | | |
|---|---|---|---|
| JP | 2008-155628 | A | 7/2008 |
| JP | 2016-055570 | A | 4/2016 |
| JP | 2016-088654 | A | 5/2016 |

* cited by examiner

BASE MATERIAL PROCESSING APPARATUS AND DETECTION METHOD

CROSS REFERENCE TO RELATED APPLICATIONS

This application is the U.S. National Phase under 35 U.S.C. § 371 of International Patent Application No. PCT/JP2020/007304, filed on Feb. 25, 2020, which claims the benefits of Japanese Patent Application No. 2019-060170, filed on Mar. 27, 2019 the entire contents of which are hereby incorporated by reference.

BACKGROUND OF THE INVENTION

Field of the Invention

The present invention relates to a technique for use in a base material processing apparatus that processes a long band-like base material while transporting the base material, and for detecting a transport error in transporting the base material in a transport direction.

Background Art

Inkjet image recording apparatuses are conventionally known, in which an image is recorded on long band-like printing paper by ejecting ink from a plurality of recording heads while transporting the printing paper in a longitudinal direction of the printing paper. The image recording apparatuses eject ink of different colors from a plurality of heads. Then, single-color images formed by each color ink are superimposed on one above another to record a multicolor image on a surface of the printing paper. Such an image recording apparatus is described in, for example, Patent Literature 1.

CITATION LIST

Patent Literature

Patent Literature 1: Japanese Patent Application Laid-Open No. 2016-55570

SUMMARY OF INVENTION

Technical Problem

This type of image recording apparatuses are designed to transport printing paper at a constant speed with use of a plurality of rollers. However, a transport speed of the printing paper under the recording heads may differ from an ideal transport speed due to skids occurring between the printing paper and the surface of each roller or due to elongation of the printing paper caused by the ink. This may result in so-called misregistration in which the ejection position of each color ink on the surface of the printing paper deviates in the transport direction.

In order to suppress such misregistration, reference images such as register marks are formed on the surface of printing paper in conventional cases. An image recording apparatus detects the positions of the reference images and corrects the ejection positions of ink from each recording head on the basis of the result of the detection. However, the reference images are formed at the same intervals as the intervals of print images in the transport direction of the printing paper. Thus, it is difficult to closely detect a transport error of printing paper on the basis of the reference images. There is also a problem in that the formation of the reference images on the surface of printing paper narrows space for recording target print images.

In order to find a transport error of printing paper without depending on register marks, for example, it is conceivable that the micro shape of the edge of printing paper itself is detected by an optical sensor, and the result of the detection is used to calculate a transport error of the printing paper. However, even in that case, the optical sensor performs detection operations at preset fixed time intervals. Thus, there is a problem in that it is difficult to detect a transport error of a base material with a higher degree of precision than the time intervals of the detection operations by the sensor.

Solution to Problem

The present invention has been made in light of such circumstances, and it is an object of the present invention to provide a technique for use in a base material processing apparatus that processes a long band-like base material while transporting the base material in the longitudinal direction, and for detecting a transport error in the transport direction of the base material with a higher degree of precision than the time intervals of detection operations by a sensor without depending on images such as register marks formed on the surface of the base material.

In order to solve the problems described above, a first aspect of the present application is a base material processing apparatus that includes a transport mechanism that transports a long band-like base material in a longitudinal direction along a predetermined transport path, a first detector that intermittently detects a position of an edge of the base material in a width direction at a first detection position in the transport path to acquire a first detection result that is time-series data, a second detector that intermittently detects the position of the edge of the base material in the width direction at a second detection position located downstream of the first detection position in the transport path to acquire a second detection result that is time-series data, a controller that controls operations of the first detector and the second detector, and an arithmetic unit that calculates a transport error in a transport direction of the base material by comparison between the first detection result and the second detection result. The controller includes a timing adjuster that changes detection timing of at least one of the first detector and the second detector.

A second aspect of the present application is the base material processing apparatus according to the first aspect, in which the arithmetic unit executes processing for calculating a degree of matching between section data included in the first detection result and section data included in the second detection result by comparison therebetween, while changing a time in each piece of the section data, to calculate statistics of the degree of matching and calculate the transport error of the base material in accordance with the statistics.

A third aspect of the present application is the base material processing apparatus according to the first or second aspect, in which the timing adjuster changes at random a time interval in detection timing of at least one of the first detector and the second detector.

A fourth aspect of the present application is the base material processing apparatus according to the first or second aspect, in which the timing adjuster shifts detection timing of at least one of the first detector and the second detector while maintaining a time interval of detection timing.

A fifth aspect of the present application is the base material processing apparatus according to any one of the first to fourth aspects, in which the timing adjuster changes detection timing of only one of the first detector and the second detector.

A sixth aspect of the present application is the base material processing apparatus according to any one of the first to fourth aspects, in which the timing adjuster changes detection timing of both of the first detector and the second detector.

A seventh aspect of the present application is the base material processing apparatus according to any one of the first to sixth aspects that further includes a processing unit that processes the base material at a processing position in the transport path. The arithmetic unit calculates the transport error of the base material at the processing position.

An eighth aspect of the present application is the base material processing apparatus according to the seventh aspect, in which the processing position is located between the first detection position and the second detection position.

A ninth aspect of the present application is the base material processing apparatus according to the seventh or eighth aspect, in which the processing unit is an image recorder that records an image by ejecting ink on a surface of the base material.

A tenth aspect of the present application is the base material processing apparatus according to the ninth aspect, in which the arithmetic unit calculates a correction value based on the transport error calculated, and the controller further includes an operation indicator that corrects an operation of the image recorder in accordance with the correction value.

An eleventh aspect of the present application is a detection method for detecting a transport error in a transport direction of a long band-like base material while transporting the base material in a longitudinal direction along a predetermined transport path. The detection method includes a) intermittently detecting a position of an edge of the base material in a width direction at a first detection position in the transport path to acquire a first detection result that is time-series data, b) intermittently detecting the position of the edge of the base material in the width direction at a second detection position located downstream of the first detection position in the transport path to acquire a second detection result that is time-series data, c) changing detection timing in at least one of the step a) and the step b), and d) calculating the transport error of the base material by comparison between the first detection result and the second detection result.

A twelfth aspect of the present application is a base material processing apparatus that includes a transport mechanism that transports a long band-like base material in a longitudinal direction along a predetermined transport path, a first detector that intermittently detects a position of an edge of the base material in a width direction at a first detection position in the transport path to acquire a first detection result that indicates a change over time in the position of the edge of the base material in the width direction at the first detection position, a second detector that intermittently detects the position of the edge of the base material in the width direction at a second detection position located downstream of the first detection position in the transport path to acquire a second detection result that indicates a change over time in the position of the edge of the base material at the second detection position, a controller that controls operations of the first detector and the second detector, and an arithmetic unit that calculates a time difference between a time when the position of the edge of the base material is detected by the first detector and a time when the position of the edge of the base material is detected by the second detector by comparison between the first detection result and the second detection result, and calculates an actual transport time of the base material from the first detection position to the second detection position in accordance with the time difference. The controller includes a timing adjuster that changes detection timing of at least one of the first detector and the second detector.

A thirteenth aspect of the present application is the base material processing apparatus according to the twelfth aspect that further includes a processing unit that processes the base material at a processing position in the transport path. The arithmetic unit calculates an actual transport speed of the base material in the processing unit in accordance with the transport time calculated.

A fourteenth aspect of the present application is the base material processing apparatus according to the thirteenth aspect, in which the arithmetic unit calculates an arrival time when each part of the base material arrives at the processing unit, in accordance with the transport speed calculated, and calculates an amount of misregistration in the transport direction of each part of the base material in accordance with the arrival time relative to a case where the base material is transported at an ideal transport speed.

Advantageous Effects of Invention

According to the first to tenth aspects of the present application, part of the first detection result and part of the second detection result can be compared with timing different from the predetermined timing by changing the detection timing of at least one of the first detector and the second detector. This enables high-precision calculation of the transport error of the base material.

According to the eleventh aspect of the present application, part of the first detection result and part of the second detection result can be compared with timing different from the predetermined timing by changing the detection timing in at least one of steps a) and b). This enables high-precision calculation of the transport error of the base material.

According to the twelfth to fourteenth aspects of the present application, part of the first detection result and part of the second detection result can be compared with timing different from the predetermined timing by changing the detection timing of at least one of the first detector and the second detector. This allows the arithmetic unit to precisely calculate an actual transport time of the base material from the first detection position to the second detection position.

These and other objects, features, aspects and advantages of the present invention will become more apparent from the following detailed description of the present invention when taken in conjunction with the accompanying drawings.

DESCRIPTION OF EMBODIMENTS

Hereinafter, an embodiment of the present invention will be described with reference to the drawings.

1. Configuration of Image Recording Apparatus

Figure 1:
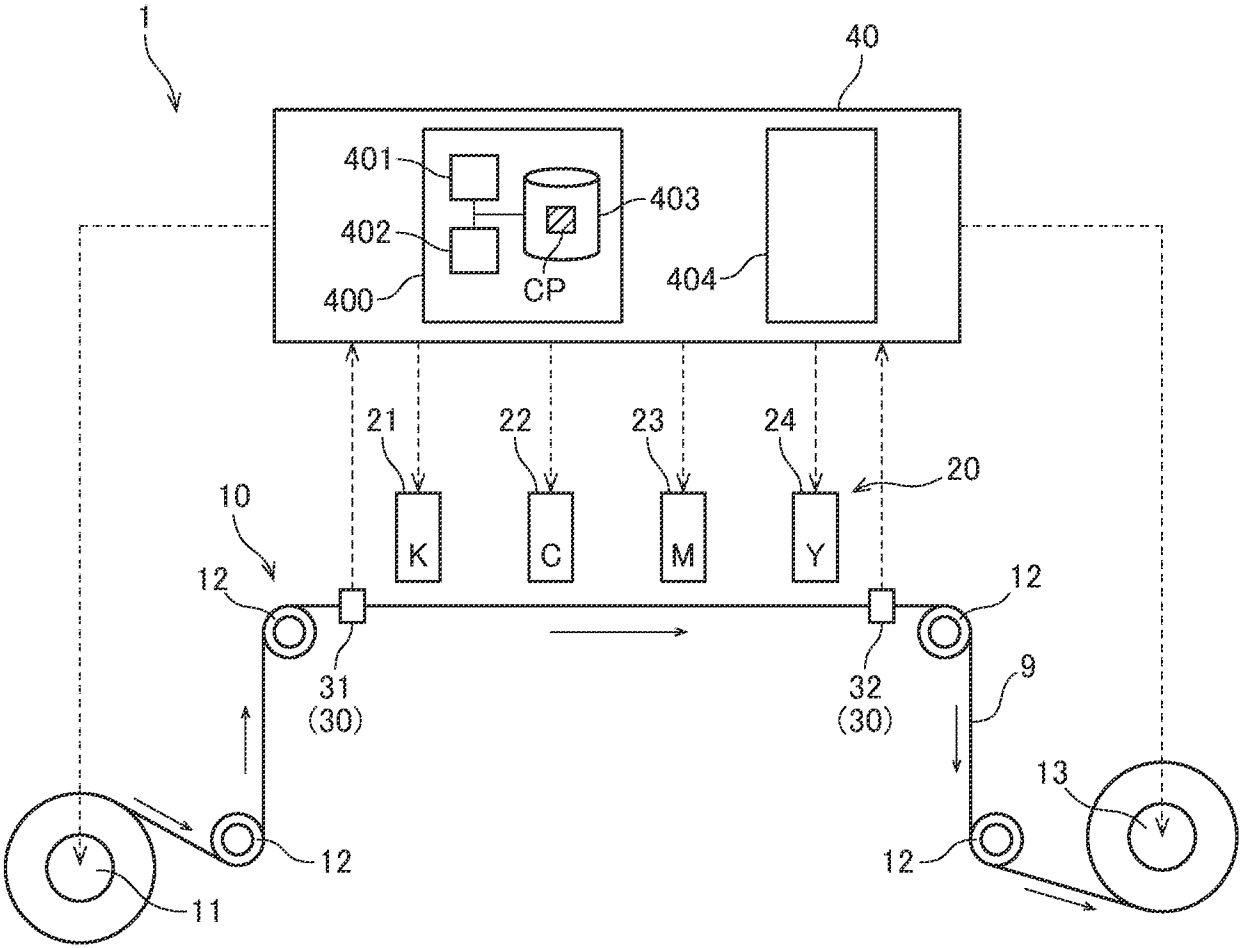
FIG. 1 is an illustration of a configuration of an image recording apparatus.

FIG. 1 is an illustration of a configuration of an image recording apparatus 1 as one example of a base material processing apparatus according to the present invention. The image recording apparatus 1 is an inkjet printing apparatus that records an image on printing paper 9, which is a long band-like base material, by ejecting ink from a plurality of recording heads 21 to 24 toward the printing paper 9 while transporting the printing paper 9. As illustrated in FIG. 1, the image recording apparatus 1 includes a transport mechanism 10, an image recorder 20, two edge sensors 30, and a controller 40.

The transport mechanism 10 is a mechanism for transporting the printing paper 9 in a transport direction along a longitudinal direction of the printing paper 9. The transport mechanism 10 according to the present embodiment includes a plurality of rollers including a feed roller 11, a plurality of transport rollers 12, and a take-up roller 13. The printing paper 9 is fed from the feed roller 11 and transported along a transport path configured of the transport rollers 12. Each transport roller 12 rotates about a horizontal axis to guide the printing paper 9 to the downstream side of the transport path. The transported printing paper 9 is collected by the take-up roller 13. These rollers are rotationally driven by the controller 40.

As illustrated in FIG. 1, the printing paper 9 travels substantially in parallel with the direction of alignment of the recording heads 21 to 24 under the recording heads 21 to 24. At this time, a record surface of the printing paper 9 faces upward (toward the recording heads 21 to 24). The printing paper 9 runs under tension over the transport rollers 12. This configuration suppresses the occurrence of slack or creases in the printing paper 9 during transport.

The image recorder 20 is a processing unit that ejects droplets of ink (hereinafter, referred to as "ink droplets") onto the printing paper 9 that is being transported by the transport mechanism 10. The image recorder 20 according to the present embodiment includes the first recording head 21, the second recording head 22, the third recording head 23, and the fourth recording head 24. The first, second, third, and fourth recording heads 21 to 24 are arranged along the transport path of the printing paper 9.

Figure 2:
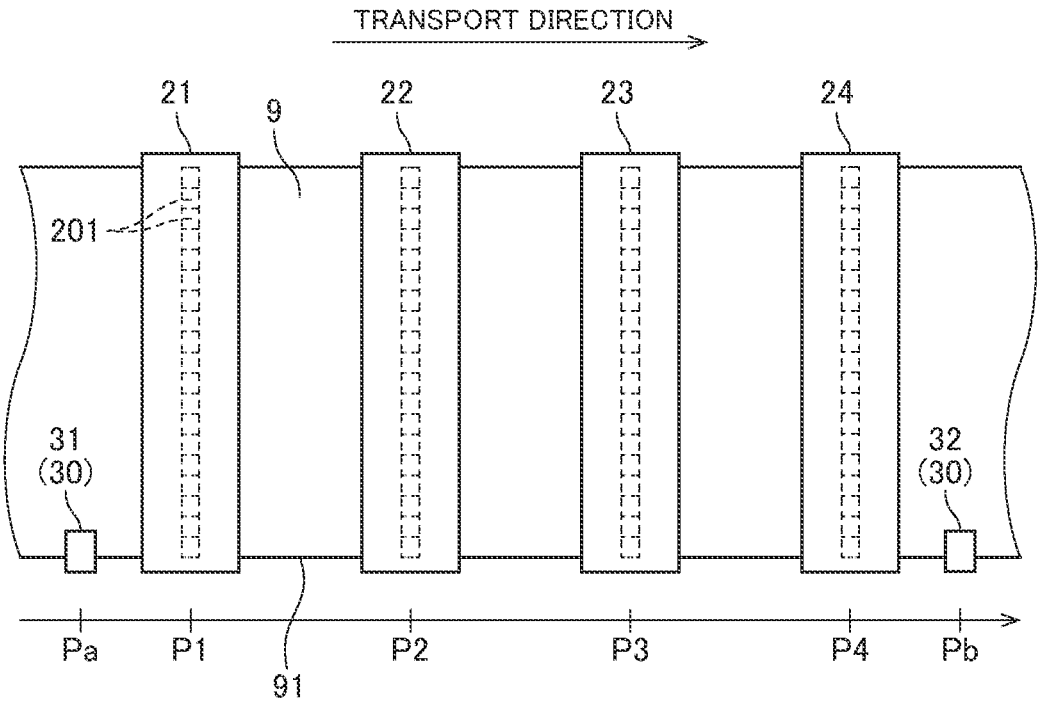
FIG. 2 is a partial top view of the image recording apparatus in the vicinity of an image recorder.

FIG. 2 is a partial top view of the image recording apparatus 1 in the vicinity of the image recorder 20. The four recording heads 21 to 24 each cover the overall dimension of the printing paper 9 in the width direction. As indicated by broken lines in FIG. 2, each of the recording heads 21 to 24 has a lower surface provided with a plurality of nozzles 201 aligned in parallel with the width direction of the printing paper 9. The recording heads 21 to 24 eject black (K), cyan (C), magenta (M), and yellow (Y) ink droplets, respectively, which are color components of a multicolor image, from the nozzles 201 toward the upper surface of the printing paper 9.

Specifically, the first recording head 21 ejects K ink droplets onto the upper surface of the printing paper 9 at a first processing position P1 in the transport path. The second recording head 22 ejects C ink droplets onto the upper surface of the printing paper 9 at a second processing position P2 located downstream of the first processing position P1. The third recording head 23 ejects M ink droplets onto the upper surface of the printing paper 9 at a third processing position P3 located downstream of the second processing position P2. The fourth recording head 24 ejects Y ink droplets onto the upper surface of the printing paper 9 at a fourth processing position P4 located downstream of the third processing position P3. In the present embodiment, the first, second, third, and fourth processing positions P1 to P4 are aligned at equal intervals in the transport direction of the printing paper 9.

The four recording heads 21 to 24 each record a single-color image on the upper surface of the printing paper 9 by ejecting ink droplets. Then, the four single-color images are superimposed on one above another so that a multicolor image is formed on the upper surface of the printing paper 9. Thus, if the positions of the ink droplets ejected from the four recording heads 21 to 24 in the transport direction are misaligned on the printing paper 9, the image quality of printed matter will deteriorate. Therefore, it becomes an important factor to bring such mutual misalignments (so-called misregistration) of the single-color images on the printing paper 9 within tolerances in order to improve the print quality of the image recording apparatus 1.

Note that a dry processing unit for drying the ink ejected onto the record surface of the printing paper 9 may be further provided downstream of the recording heads 21 to 24 in the transport direction. For example, the dry processing unit may be configured to dry the ink by blowing heated gas toward the printing paper 9 so as to vaporize a solvent in the ink adhering to the printing paper 9. Alternatively, the dry processing unit may be configured to wind the printing paper 9 around a heat roller and heat and dry the ink adhering to the printing paper 9. As another alternative, the dry processing unit may be configured to dry the ink by other methods such as photoirradiation.

The two edge sensors 302 are detectors that detect the position of an edge 91 of the printing paper 9 in the width direction. In the present embodiment, the edge sensors 30 are arranged at a first detection position Pa located upstream of the first processing position P1 in the transport path and at a second detection position Pb located downstream of the fourth processing position P4 in the transport path.

Figure 3:
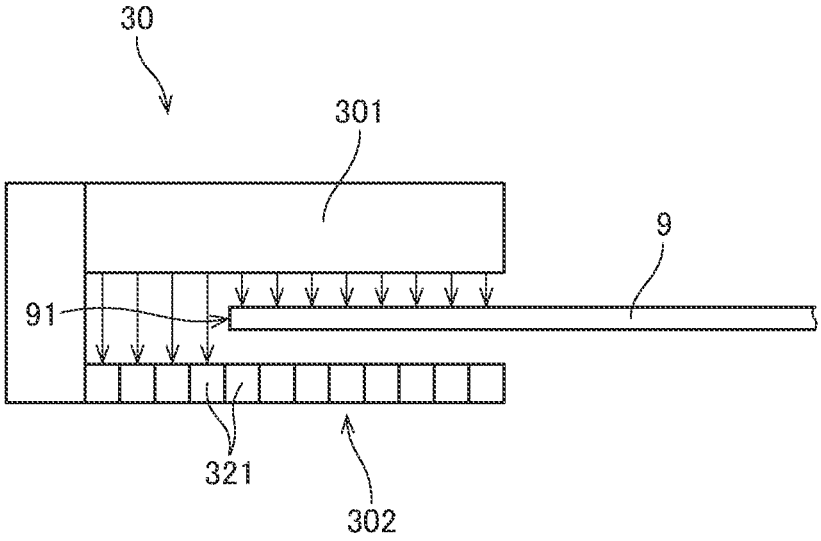
FIG. 3 is a schematic illustration of a structure of an edge sensor.

FIG. 3 is a schematic illustration of the structure of one edge sensor 30. As illustrated in FIG. 3, the edge sensor 30 includes a projector 301 located above the edge 91 of the printing paper 9, and a line sensor 302 located below the edge 91. The projector 301 emits parallel light downward. The line sensor 302 includes a plurality of light receiving elements 321 aligned in the width direction. As illustrated in FIG. 3, outside the edge 91 of the printing paper 9, the light emitted from the projector 301 enters light receiving elements 321 and is detected by these light receiving elements 321. On the other hand, inside the edge 91 of the printing paper 9, the light emitted from the projector 301 is blocked by the printing paper 9 and is thus not detected by any light receiving elements 321. The edge sensor 30 detects the position of edge 91 of the printing paper 9 in the width direction on the basis of whether the light has been detected by the light receiving elements 321.

As illustrated in FIGS. 1 and 2, the edge sensor 30 arranged at the first detection position Pa is hereinafter referred to as a "first edge sensor 31." The edge sensor 30 arranged at the second detection position Pb is hereinafter referred to as a "second edge sensor 32."

The first edge sensor 31 is one example of a "first detector" according to the present invention. The first edge sensor 31 intermittently detects the position of the edge 91 of the printing paper 9 in the width direction at the first detection position Pa. The first edge sensor 31 thereby acquires a detection result (hereinafter referred to as a "first detection result Ra") that indicates a change over time in the position of the edge 91 in the width direction at the first detection position Pa. Then, the first edge sensor 31 outputs a detection signal indicating this first detection result Ra to the controller 40.

The second edge sensor 32 is one example of a "second detector" according to the present invention. The second edge sensor 32 intermittently detects the position of the edge 91 of the printing paper 9 in the width direction at the second detection position Pb. The second edge sensor 32 thereby acquires a detection result (hereafter referred to as a "second detection result Rb") that indicates a change over time in the position of the edge 91 in the width direction at the second detection position Pb. Then, the second edge sensor 32 outputs a detection signal indicating this second detection result Rb to the controller 40.

The controller 40 is means for controlling operations of each unit in the image recording apparatus 1. As schematically illustrated in FIG. 1, the controller 40 is configured by a computer 400 and an electric circuit 404, the computer 400 including a processor 401 such as a CPU, a memory 402 such as a RAM, and a storage 403 such as a hard disk drive. The storage 403 stores a computer program CP for executing print processing. As indicated by broken lines in FIG. 1, the controller 40 is electrically connected to each of the transport mechanism 10, the four recording heads 21 to 24, and the two edge sensors 30, which are described above. The controller 40 controls operations of these units in accordance with the computer program CP. In this way, the print processing proceeds in the image recording apparatus 1.

2. Detection and Correction Processing

The controller 40 acquires detection signals from the first edge sensor 31 and the second edge sensor 32 during execution of the print processing. The controller 40 then detects a transport error in the transport direction of the printing paper 9 on the basis of the acquired detection signals. On the basis of the detected transport error, the controller 40 also corrects the timing of ejecting ink droplets from the four recording heads 21 to 24. In this way, the aforementioned misregistration is suppressed.

Figure 4:
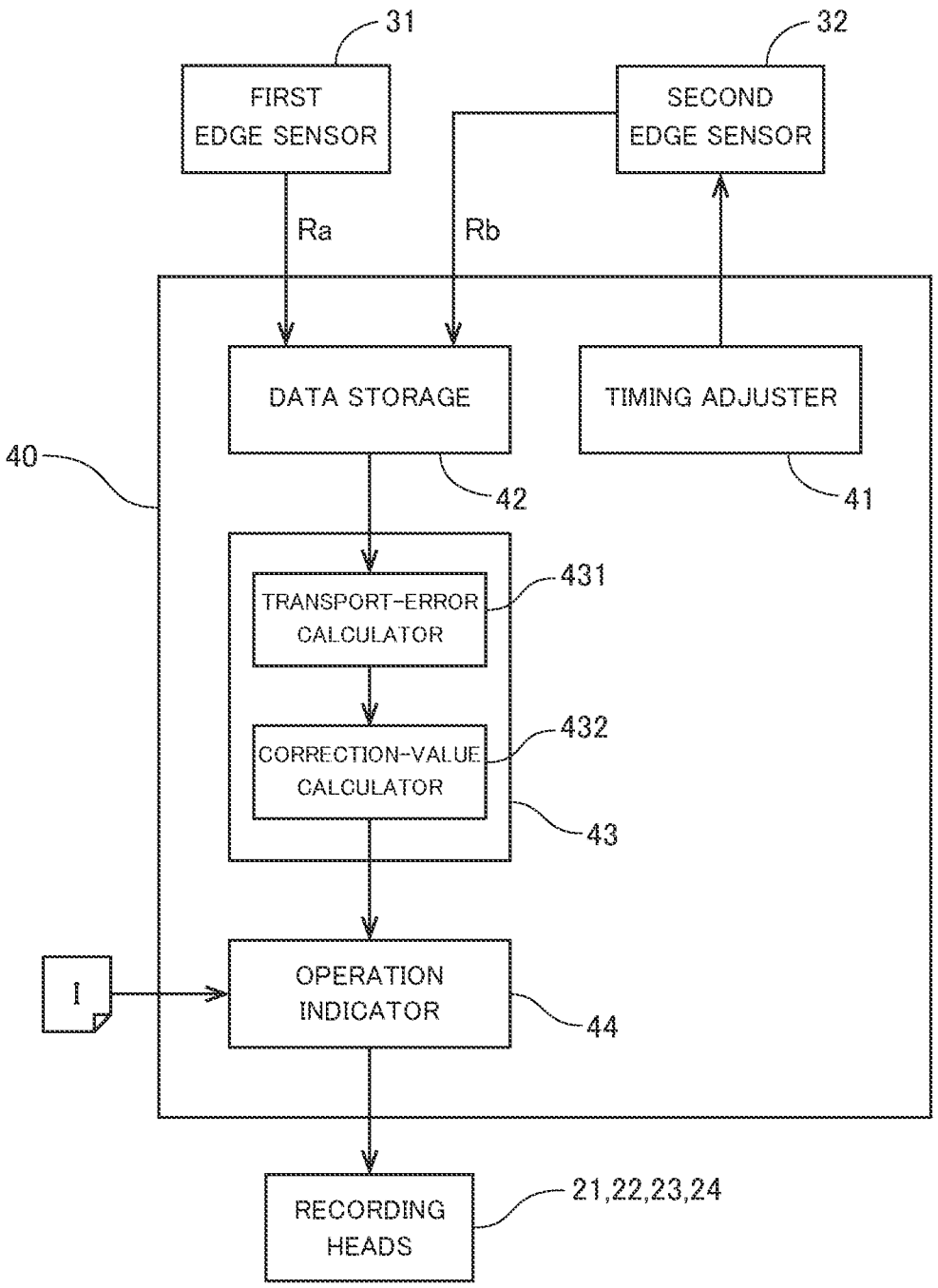
FIG. 4 is a block diagram conceptually illustrating functions of a controller.

FIG. 4 is a block diagram schematically illustrating functions of the controller 40 for implementing the detection and correction processing as described above. As illustrated in FIG. 4, the controller 40 includes a timing adjuster 41, data storage 42, an arithmetic unit 43, and an operation indicator 4. The arithmetic unit 43 includes a transport-error calculator 431 and a correction-value calculator 432. The functions of the data storage 42, the arithmetic unit 43, and the operation indicator 44 are achieved by the computer 400 operating in accordance with the computer program CP. The function of the timing adjuster 41 is achieved by, for example, the electric circuit 404. Note that the function of the timing adjuster 41 may be achieved by the computer 400.

Figure 5:
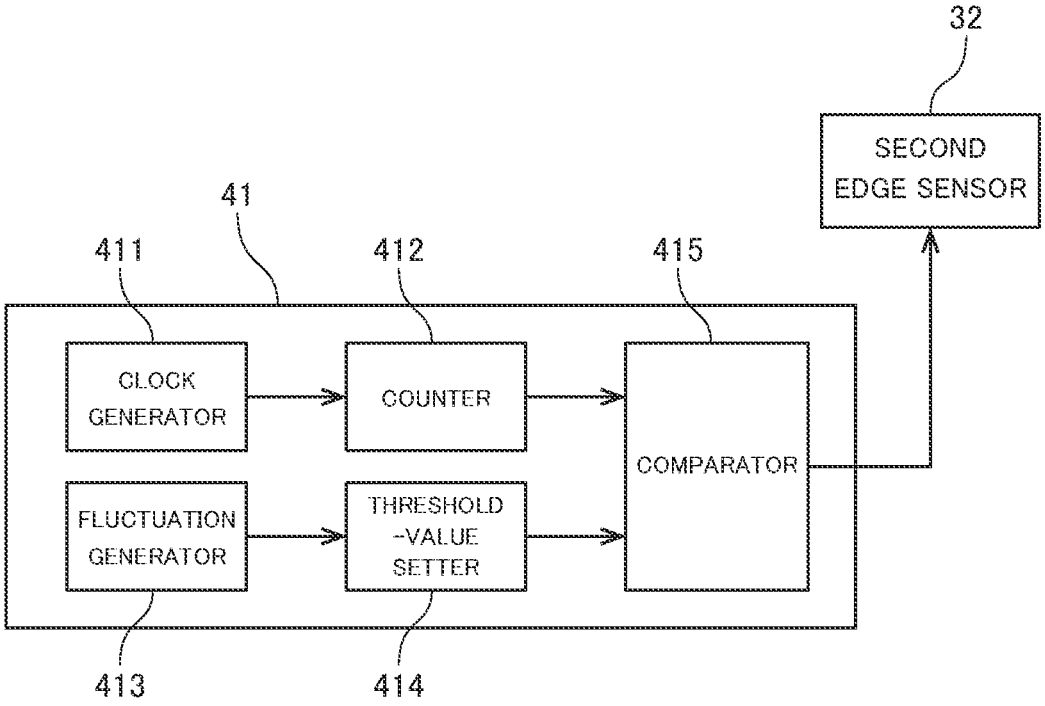
FIG. 5 is a block diagram illustrating a configuration of a timing adjuster.

The timing adjuster 41 changes detection timing of the second edge sensor 32 at random. FIG. 5 is a block diagram illustrating a detailed configuration of the timing adjuster 41. As illustrated in FIG. 5, the timing adjuster 41 includes a clock generator 411, a counter 412, a fluctuation generator 413, a threshold-value setter 414, and a comparator 415.

The clock generator 411 generates a clock signal that indicates a square-wave voltage having a fixed infinitesimal period. The period of square waves in the clock signal is shorter enough than a standard detection period (time interval Δt, which will be described later) of the first and second edge sensors 31 and 32. The counter 412 counts the number of square waves (the number of clocks) in the clock signal, which is input from the clock generator 411. The fluctuation generator 413 generates a voltage signal that changes regularly or irregularly. The threshold-value setter 414 sets a threshold value used in the comparator 415. The threshold-value setter 414 uses the voltage signal received from the fluctuation generator 413 to cause the set threshold value to fluctuate.

The comparator 415 compares the count value of the counter 412 and the threshold value set by the threshold-value setter 414. When the count value of the counter 412 has reached the threshold value, the comparator 415 outputs a control signal to instruct execution of detection to the second edge sensor 32 and resets the count value of the counter 412. This changes the detection timing of the second edge sensor 32 at time intervals corresponding to the threshold value that changes regularly or irregularly, not at fixed time intervals Δt. Accordingly, the second edge sensor 32 is capable of detecting the position of the edge 91 of the printing paper 9 in the width direction at unequal time intervals.

The data storage 42 receives the first detection result Ra that is output in sequence from the first edge sensor 31 and the second detection result Rb that is output in sequence from the second edge sensor 32. Then, the data storage 42 stores the received first and second detection results Ra and Rb as time-series data. Specifically, the first and second detection results Ra and Rb are stored in the memory 402 of the computer that configures the controller 40.

Figure 6:
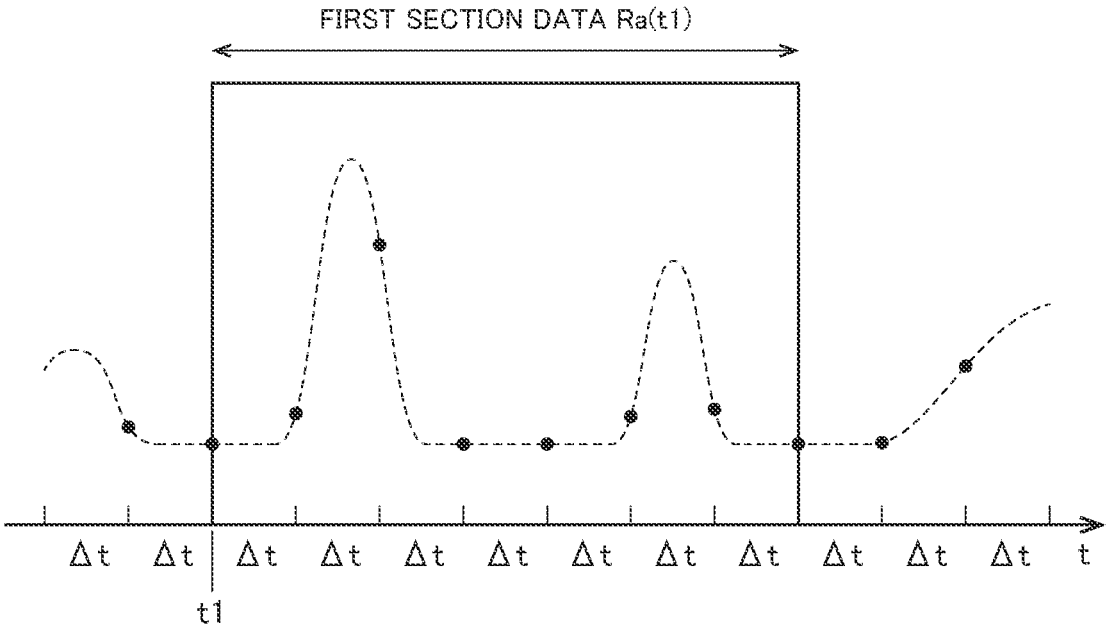
FIG. 6 shows an example of a first detection result.

FIG. 6 shows an example of the first detection result Ra. The horizontal axis in FIG. 6 indicates the operating time t of the first edge sensor 31. The vertical axis in FIG. 6 indicates the value detected by the first edge sensor 31 (the position of the edge 91 of the printing paper 9 in the width direction). The edge 91 of the printing paper 9 has fine irregularities. The first edge sensor 31 detects the position of the edge 91 of the printing paper 9 in the width direction at the first detection position Pa at predetermined fixed time intervals Δt (e.g., at time intervals of 50 microseconds). This produces data that indicates a change over time in the position of the edge 91 of the printing paper 9 in the width direction as illustrated in FIG. 6.

The first detection result Ra makes data that reflects the shape of the edge 91 of the printing paper 9 passing through the first detection position Pa. Note that the first edge sensor 31 detects the position of the edge 91 of the printing paper 9 in the width direction at predetermined fixed time intervals Δt. Thus, as illustrated in FIG. 6, the first detection result Ra makes a discontinuous data stream that includes only the detection values for portions (black dots in FIG. 6) that correspond to the times of detection out of the actual shape (broken line in FIG. 6) of the edge 91 of the printing paper 9.

Figure 7:
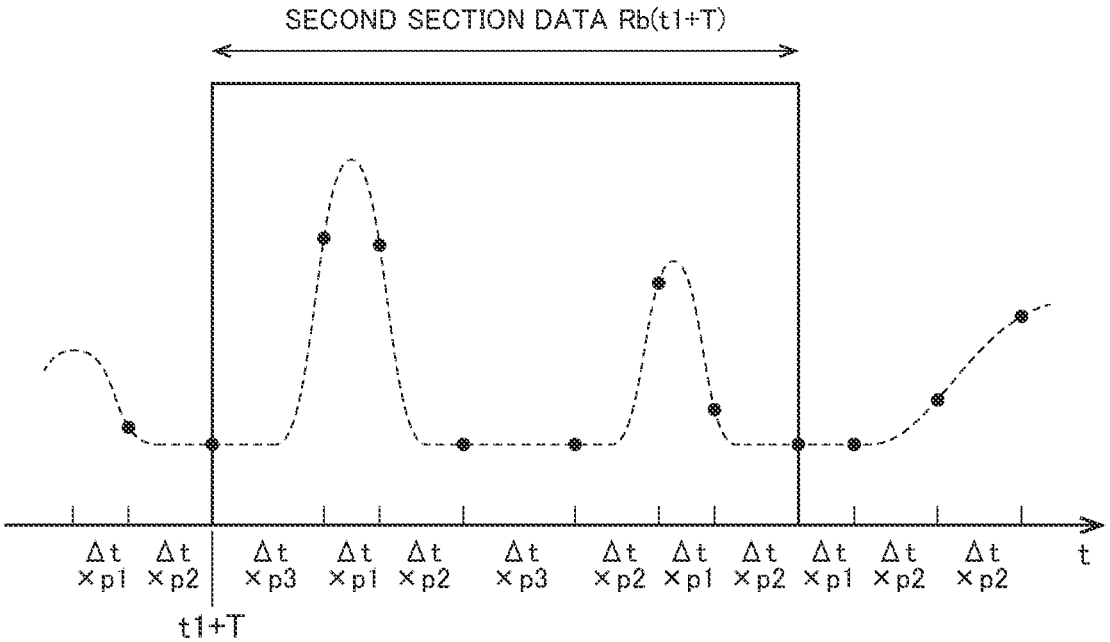
FIG. 7 shows an example of a second detection result.

FIG. 7 shows an example of the second detection result Rb. The horizontal axis in FIG. 7 indicates the operating time t of the second edge sensor 32. The vertical axis in FIG. 7 indicates the value detected by the second edge sensor 32 (the position of the edge 91 of the printing paper 9 in the width direction). The second edge sensor 32 also intermittently detects the position of the edge 91 of the printing paper 9 in the width direction at the second detection position Pb. Thus, the second detection result Rb also makes a discontinuous data stream. However, the detection timing of the second edge sensor 32 is set at random time intervals by the aforementioned timing adjuster 41. Accordingly, the time intervals between pieces of data included in the second detection result Rb are not the fixed time intervals Δt.

In the example illustrated in FIG. 7, the second edge sensor 32 performs a detection operation at time intervals selected at random from three types of time intervals Δt×p1, Δt×p2, and Δt×p3. The values p1, p2, p3 may, for example, be set to 0.5, 1.0, and 1.5, respectively. However, the form of changing the detection timing of the second edge sensor 32 is not limited to the example illustrated in FIG. 7. The timing adjuster 41 may more finely change the detection timing of the second edge sensor 32.

The transport-error calculator 431 reads out the first detection result Ra and the second detection result Rb from the data storage 42. The transport-error calculator 431 then compares the first detection result Ra and the second detection result Rb to identify points at which the same edge 91 of the printing paper 9 has been detected from the first detection result Ra and the second detection result Rb. In this way, the transport-error calculator 431 calculates a transport error in the transport direction of the printing paper 9.

Figure 8:
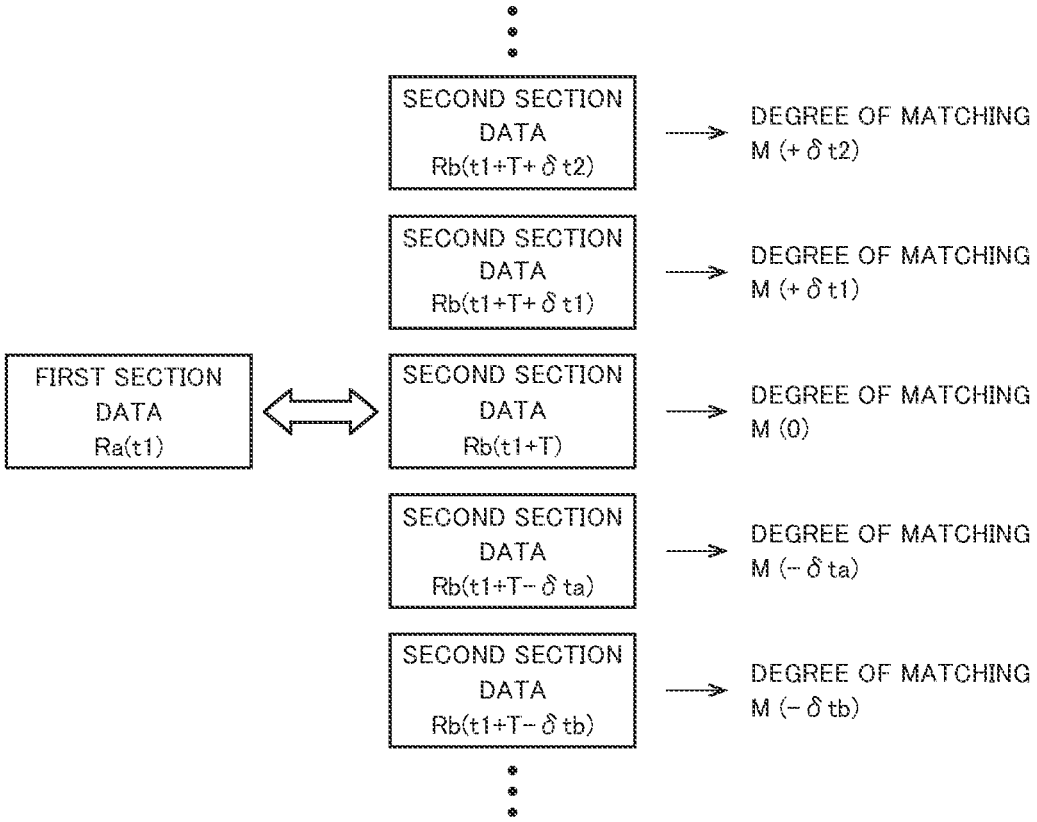
FIG. 8 is a schematic illustration of comparison processing performed by a transport-error calculator.

FIG. 8 is a schematic illustration of the comparison processing performed by the transport-error calculator 431. As illustrated in FIG. 8, the transport-error calculator 431 compares section data included in the first detection result Ra with section data included in the second detection result Rb. Here, a data stream included within a predetermined time range from a given time tin the first detection result Ra is referred to as first section data Ra(t). Also, a data stream included within the predetermined time range from the given time tin the second detection result Rb is referred to as second section data Rb(t). An ideal time required to transport the printing paper 9 from the first detection position Pa to the second detection position Pb is referred to as an ideal transport time T.

First, the transport-error calculator 431 compares the first section data Ra(t1) obtained at the given time t1 with second section data Rb(t1+T) obtained after a lapse of the ideal transport time T from the time t1. Then, the transport-error calculator 431 calculates the degree of matching M(0) between the first section data Ra(t1) and the second section data Rb(t1+T). For example, the calculation of the degree of matching M uses a matching technique such as cross-correlation or residual sum of squares.

Then, the transport-error calculator 431 compares the first section data Ra(t1) at the time t1 with second section data Rb(t1+T+δt) obtained at a time that is shifted by an extremely small amount of time δt from a time t1+T. Then, the transport-error calculator 431 calculates the degree of matching M(δt) between the first section data Ra(t1) and the second section data Rb(t1+T+δt).

The transport-error calculator 431 changes the amount of time δt by which the second section data Rb(t1+T+δt) is shifted (hereinafter, referred to as a shifting time) on both plus and minus sides ( . . . , −δtb, −δta, 0, +δt1, +δt2, and so on). Then, the transport-error calculator 431 compares the first section data Ra(t1) with the second section data Rb(t1+T+δt) for each shifting time δt. As a result, a plurality of the degrees of matching ( . . . , M(−δtb), M(−δta), 0, M(+δt1), M(+δt2), and so on), each corresponding to each shifting time δt, are calculated as illustrated in FIG. 8.

The transport-error calculator 431 further changes the aforementioned time t1 and repeatedly executes the comparison processing illustrated in FIG. 8. That is, the transport-error calculator 431 calculates the degrees of matching M(δt) between a plurality of pieces of second section data Rb(t1+T+δt) and each of a plurality of pieces of first section data Ra(t1). In this way, the transport-error calculator 431 acquires statistics of the aforementioned degree of matching M(δt). The statistics may, for example, be a sum total of the calculated degrees of matching M(δt) for each shifting time δt.

Here, if the detection timing of the second edge sensor 32 is at the fixed time interval Δt as in conventional cases, the shifting times δt of the second section data Rb(t1+T+δt) in the comparison processing illustrated in FIG. 8 also have to be set at the time intervals Δt. Specifically, for example, the shifting times δt of the second section data Rb(t1+T+δt) have to be set as follows: . . . , −2Δt, −Δt, 0, +Δt, +2Δt, and so on. In this case, irrespective of the time t1, the degrees of matching M(δt) to be calculated become as follows: . . . , M(−2Δt), M(−Δt), 0, M(+Δt), M(+2Δt), and so on.

Figure 9:
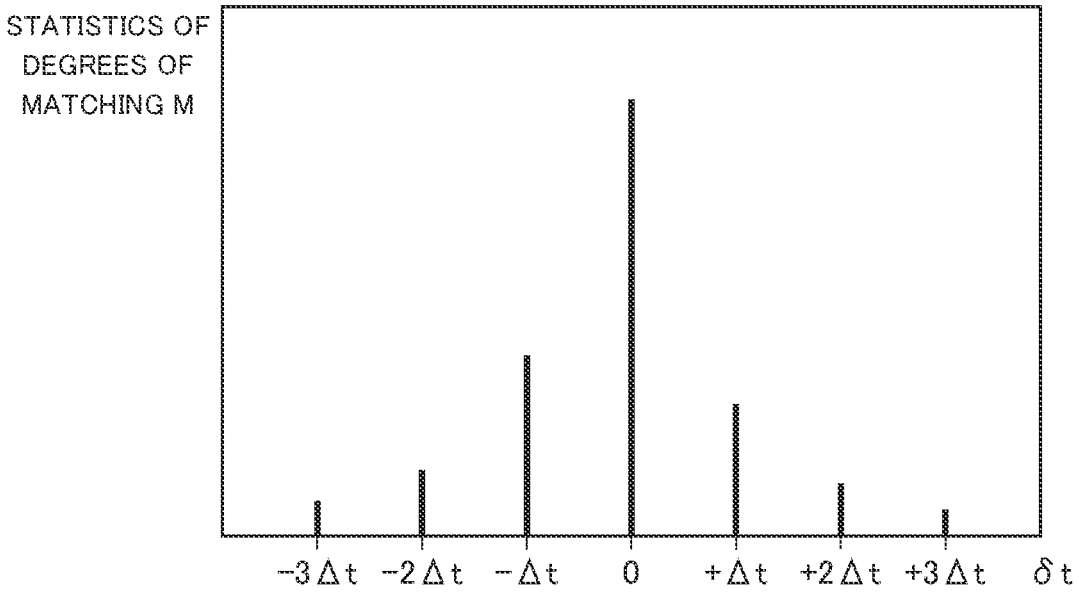
FIG. 9 is a graph showing an example of statistics of the degree of matching (comparative example) when the detection timing of a second edge sensor is set at fixed time intervals.

FIG. 9 is a graph showing an example (comparative example) of statistics of the degrees of matching M(δt) when the detection timing of the second edge sensor 32 is at the fixed time intervals Δt as described above. The horizontal axis in FIG. 9 indicates the shifting time δt of the second section data Rb(t1+T+δt) in the comparison processing illustrated in FIG. 8. The vertical axis in FIG. 9 indicates the statistics of the degrees of matching M(δt). In this comparative example, the statistics of the degrees of matching M(δt) are distributed discretely at the fixed time intervals Δt. Thus, it is difficult to identify the shifting time δt at which the degree of matching M(δt) reaches a maximum with a higher degree of precision than the time intervals Δt.

In contrast, the image recording apparatus 1 according to the present embodiment changes the detection timing of the second edge sensor 32 at random. Thus, the shifting time δt of the second section data Rb(t1+T+δt) in the aforementioned comparison processing illustrated in FIG. 8 can be set to a value that changes at random. That is, the shifting time δt of the second section data Rb(t1+T+δt) can be set at nonuniform intervals of, for example, . . . , −(p1+p2)Δt, −p2Δt, 0, +p3Δt, +(p3+p1)Δt, and so on. Besides, the shifting times δt of the second section data Rb(t1+T+δt) to be compared can be set at different values for each piece of first section data Ra.

Figure 10:
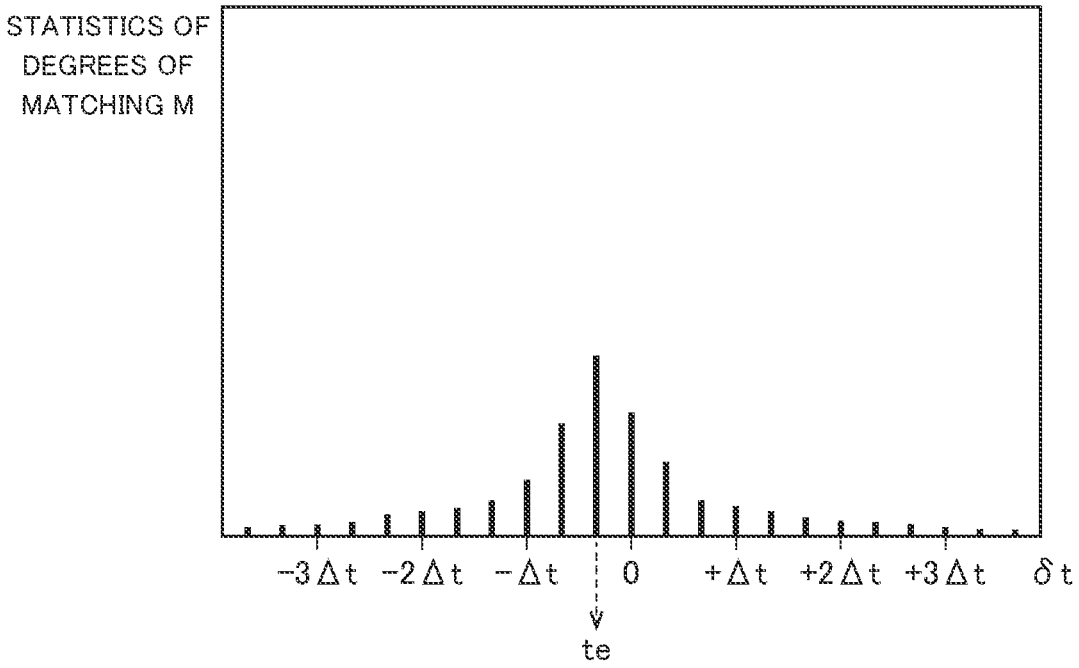
FIG. 10 is a graph showing an example of statistics of the degree of matching when the detection timing of the second edge sensor is changed at random.

FIG. 10 is a graph showing an example of the statistics of the degrees of matching M(60 when the detection timing of the second edge sensor 32 is changed at random as described above. The horizontal axis in FIG. 10 indicates the shifting time δt of the second section data Rb(t1+T+δt) in the comparison processing illustrated in FIG. 8. The vertical axis in FIG. 10 indicates the statistics of the degrees of matching M(60. In the example illustrated in FIG. 10, the statistics for each individual shifting time δt become small, but the statistics of the degrees of matching M(δt) can be obtained at shorter time intervals than in the example illustrated in FIG. 9. Accordingly, the shifting time δt at which the degree of matching M(δt) becomes a maximum can be identified more accurately than in the example illustrated in FIG. 9.

When the statistics of the degrees of matching M(δt) as illustrated in FIG. 10 are obtained, the transport-error calculator 431 determines the shifting time δt at which the degree of matching M (δt) becomes a maximum as a transport-error time te. Thereafter, the transport-error calculator 431 adds the transport-error time te to the ideal transport time T of the printing paper 9 from the first detection position Pa to the second detection position Pb. In this way, the transport-error calculator 431 calculates a time difference T+te between the time when a given point at the edge 91 of the printing paper 9 is detected by the first edge sensor 31 and the time when the same point at the edge 91 of the printing paper 91 is detected by the second edge sensor 32. This enables calculation of an actual transport time Tc (=T+te) of the printing paper 9 from the first detection position Pa to the second detection position Pb.

The transport-error calculator 431 also calculates an actual transport speed of the printing paper 9 under the image recorder 20 on the basis of the calculated actual transport time Tc of the printing paper 9. Then, on the basis of the calculated transport speed, the transport-error calculator 431 calculates the times when each part of the printing paper 9 arrives at the first processing position P1, the second processing position P2, the third processing position P3, and the fourth processing position P4. The transport-error calculator 431 also calculates, on the basis of the arrival times of the printing paper 9 at the processing positions P1, P2, P3, and P4, the amounts of misalignment of the printing paper 9 in the transport direction at the processing positions P1, P2, P3, and P4 relative to a case where the printing paper 9 is transported at an ideal transport speed.

Now, refer back to FIG. 4. The correction-value calculator 432 calculates, on the basis of the transport error calculated by the transport-error calculator 431, a correction value for correcting the timing of ejecting ink droplets from each of the recording heads 21 to 24. For example, if a portion of the printing paper 9 that records an image arrives behind ideal times at the first to fourth processing positions P1 to P4, the correction-value calculator 432 calculates a correction value that delays the timing of ejecting ink droplets from each of the recording heads 21 to 24. If a portion of the printing paper 9 that records an image arrives earlier than ideal times at the processing positions P1 to P4, the correction-value calculator 432 calculates a correction value that advances the timing of ejecting ink droplets from each of the recording heads 21 to 24. The calculated correction value is output from the correction-value calculator 432 to the operation indicator 44.

The operation indicator 44 controls the operation of ejecting ink droplets from each of the recording heads 21 to 24 on the basis of received image data I. At this time, the operation indicator 44 references the correction value for the ejection timing, the correction value being output from the correction-value calculator 432. The operation indicator 44 then corrects the original ejection timing based on the image data I in accordance with the aforementioned correction value. In this way, ink droplets of each color are ejected at appropriate points in the transport direction on the printing paper 9 at each of the processing positions P1 to P4. This suppresses mutual misalignment of the single-color images formed by each color ink. As a result, it is possible to obtain a high-quality print image with less misregistration.

As described above, the image recording apparatus 1 according to the present embodiment detects the shape of the edge 91 of the printing paper 9 at the two positions, namely the first detection position Pa and the second detection position Pb, and calculates the transport error in the transport direction of the printing paper 9 on the basis of these detection results. Thus, it is possible to detect the transport error in the transport direction of the printing paper 9 without depending on images such as register marks formed on the surface of the printing paper 9.

The term "transport error" as used herein includes an error in the transport speed of the printing paper 9 from an ideal value, an error in the arrival time of the printing paper 9 at each part in the transport path from an ideal value, and an error in the position of the printing paper 9 in the transport direction at each part in the transport path from an ideal value. The arithmetic unit 43 may calculate at least one of these errors.

In the image recording apparatus 1, the timing adjuster 41 changes the detection timing of the second edge sensor 32 at random. Thus, the first section data Ra(t1) included in the first detection result Ra and the second section data Rb(t1+T+δt) included in the second detection result Rb can be compared at time intervals δt different from the predetermined time intervals Δt. As a result, the statistics of the degrees of matching M(δt) between the first section data Ra(t1) and the second section data Rb(t1+T+δt) can be calculated at shorter time intervals than the predetermined time intervals Δt. Accordingly, it is possible to calculate the transport error of the printing paper 9 with a higher degree of precision on the basis of the statistics of the degrees of matching M(δt).

In the present embodiment, ink droplets are ejected on the record surface of the printing paper 9 located between the first detection position Pa and the second detection position Pb. Thus, even if the length of the printing paper 9 in the transport direction is locally elongated due to the adhesion of the ink, the transport error in the transport direction caused by the elongation can be obtained from the detection results obtained at the first detection position Pa and the second detection position Pb.

3. Variations

While one embodiment of the present invention has been described thus far, the present invention is not intended to be limited to the embodiment described above.

3-1. First Variation

Figure 11:
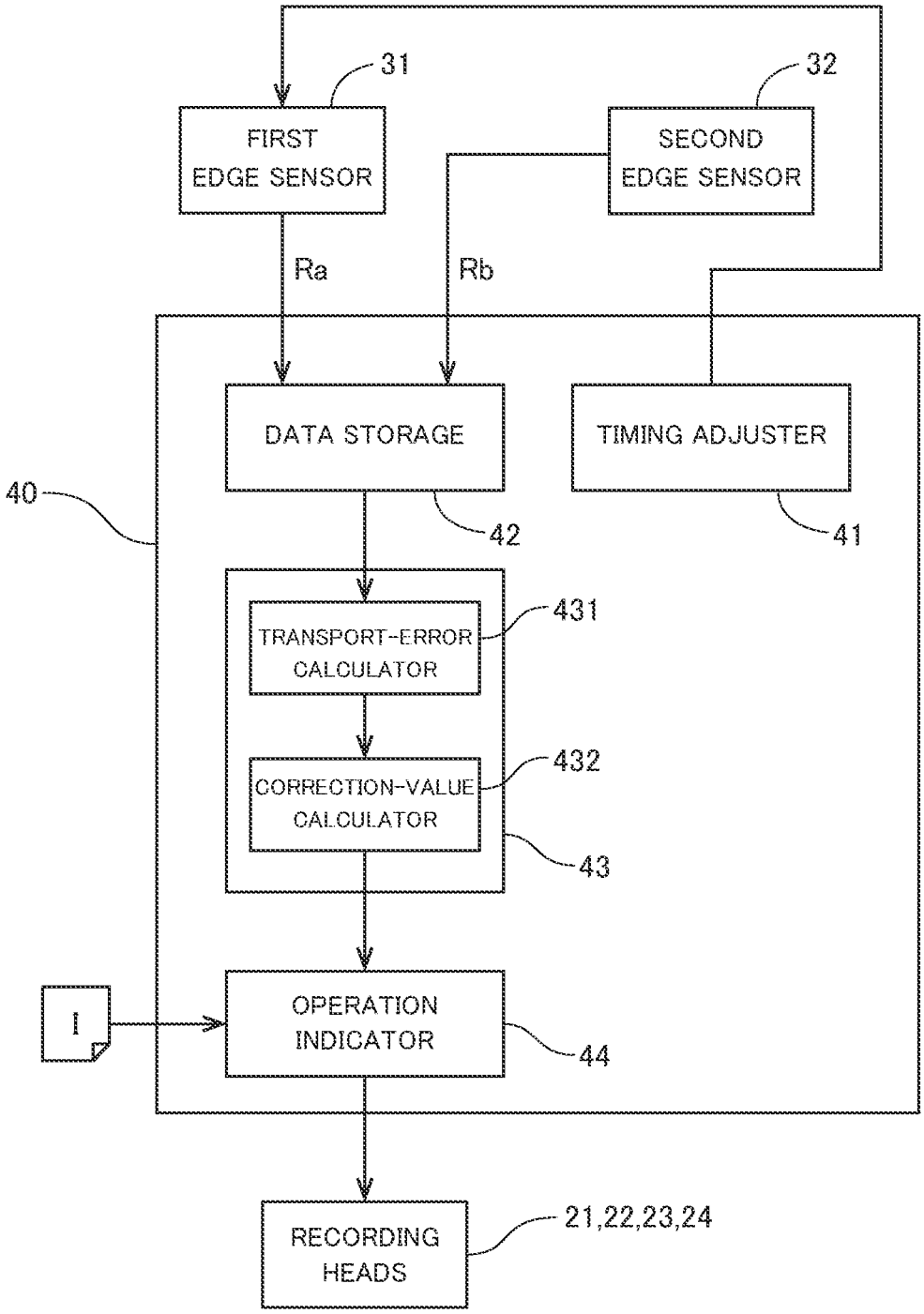
FIG. 11 is a block diagram of the controller according to a first variation.

FIG. 11 is a block diagram of the controller 40 according to a first variation. In the example illustrated in FIG. 11, the timing adjuster 41 changes the detection timing of the first edge sensor 31, instead of the detection timing of the second edge sensor 32. In the example illustrated in FIG. 11, the second edge sensor 32 detects the position of the edge 91 of the printing paper 9 in the width direction at the second detection position Pb at predetermined fixed time intervals Δt (e.g., at time intervals of 50 microseconds). On the other hand, the first edge sensor 31 detects the position of the edge 91 of the printing paper 9 at the first detection position Pa at time intervals that change at random.

Even in this case, if the roles of the first section data and the second section data in the comparison processing illustrated in FIG. 8 are reversed and the second section data Rb(t1) is compared with a plurality of pieces of first section data Ra(t1−T+δt), the statistics of the degrees of matching M(δt) can be calculated at shorter time intervals than the predetermined time intervals Δt Accordingly, the transport error of the printing paper 9 can be calculated with a higher degree of precision on the basis of the statistics of the degrees of matching M(δt).

3-2. Second Variation

Figure 12:
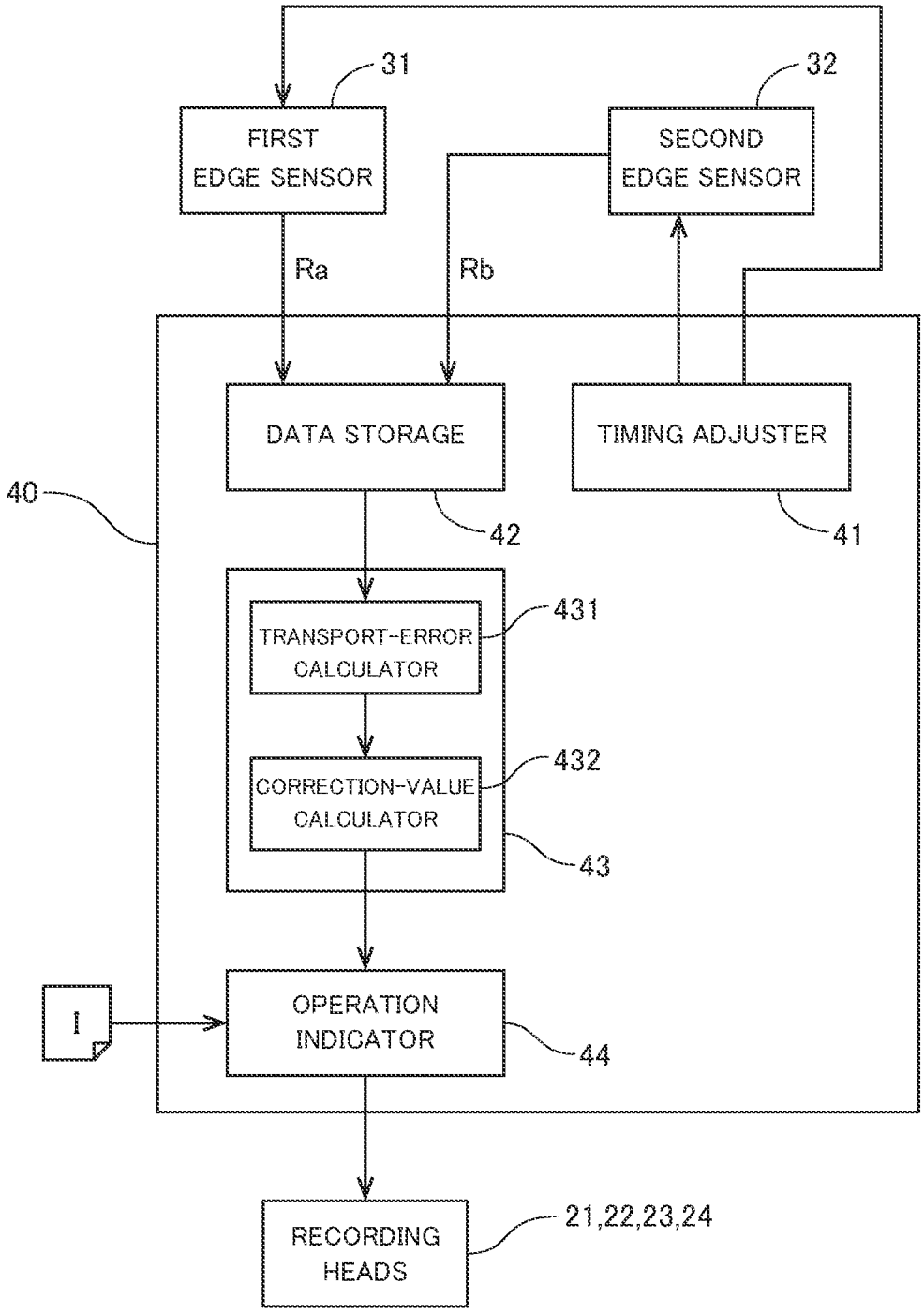
FIG. 12 is a block diagram of the controller according to a second variation.

FIG. 12 is a block diagram of the controller 40 according to a second variation. In the example illustrated in FIG. 12, the timing adjuster 41 changes the detection timing of both the first edge sensor 31 and the second edge sensor 32. Thus, in the example illustrated in FIG. 12, both of the first edge sensor 31 and the second edge sensor 32 detect the position of the edge 91 of the printing paper 9 at time intervals that change at random.

In this case, the first section data Ra(t1) may be compared with a plurality of pieces of second section data Rb(t1+T+δt) as in FIG. 8 according to the above-described embodiment. Alternatively, the roles of the first section data and the second section data may be reversed and the second section data Rb(t1) may be compared with a plurality of pieces of first section data Ra(t1−T+δt). In either case, the statistics of the degrees of matching M(δt) can be calculated at shorter time intervals than the predetermined time intervals Δt. Accordingly, the transport error of the printing paper 9 can be calculated with a high degree of precision on the basis of the statistics of the degrees of matching M(δt).

That is, the timing adjuster 41 may change the detection timing of at least one of the first edge sensor 31 and the second edge sensor 32.

3-3. Third Variation

In the above-described embodiment, the timing adjuster 41 changes the time intervals of the detection timing of the second edge sensor 32 at random. Alternatively, the timing adjuster 41 may shift the detection timing of the second edge sensor 32 while maintaining the time intervals of the detection timing. In that case, the shifting time δt of the second section data Rb(t1+T+δt) in the comparison processing illustrated in FIG. 8 can be changed before and after the shift of the detection timing. As a result, the degree of matching M(δt) can be calculated at shorter time intervals than the predetermined time intervals Δt. Accordingly, the transport error of the printing paper 9 can be calculated with a high degree of precision on the basis of the statistics of the degrees of matching M(δt).

In this way, the timing adjuster 41 may shift the detection timing of at least one of the first edge sensor 31 and the second edge sensor 32 while maintaining the time intervals of the detection timing.

3-4. Fourth Variation

In the above-described embodiment, the operation indicator 44 corrects the timing of ejecting ink droplets from the recording heads 21 to 24 without correcting the received image data I itself. Alternatively, the operation indicator 44 may correct the image data I on the basis of the correction value calculated by the correction-value calculator 432. In that case, each of the recording heads 21 to 24 may eject ink droplets in accordance with the corrected image data I. When each of the recording heads 21 to 24 includes a plurality of nozzles 201 aligned in the transport direction, the operation indicator 44 may change nozzles 201 of each of the recording heads 21 to 24 that eject ink, on the basis of the correction value calculated by the correction-value calculator 432.

3-5. Fifth Variation

Figure 13:
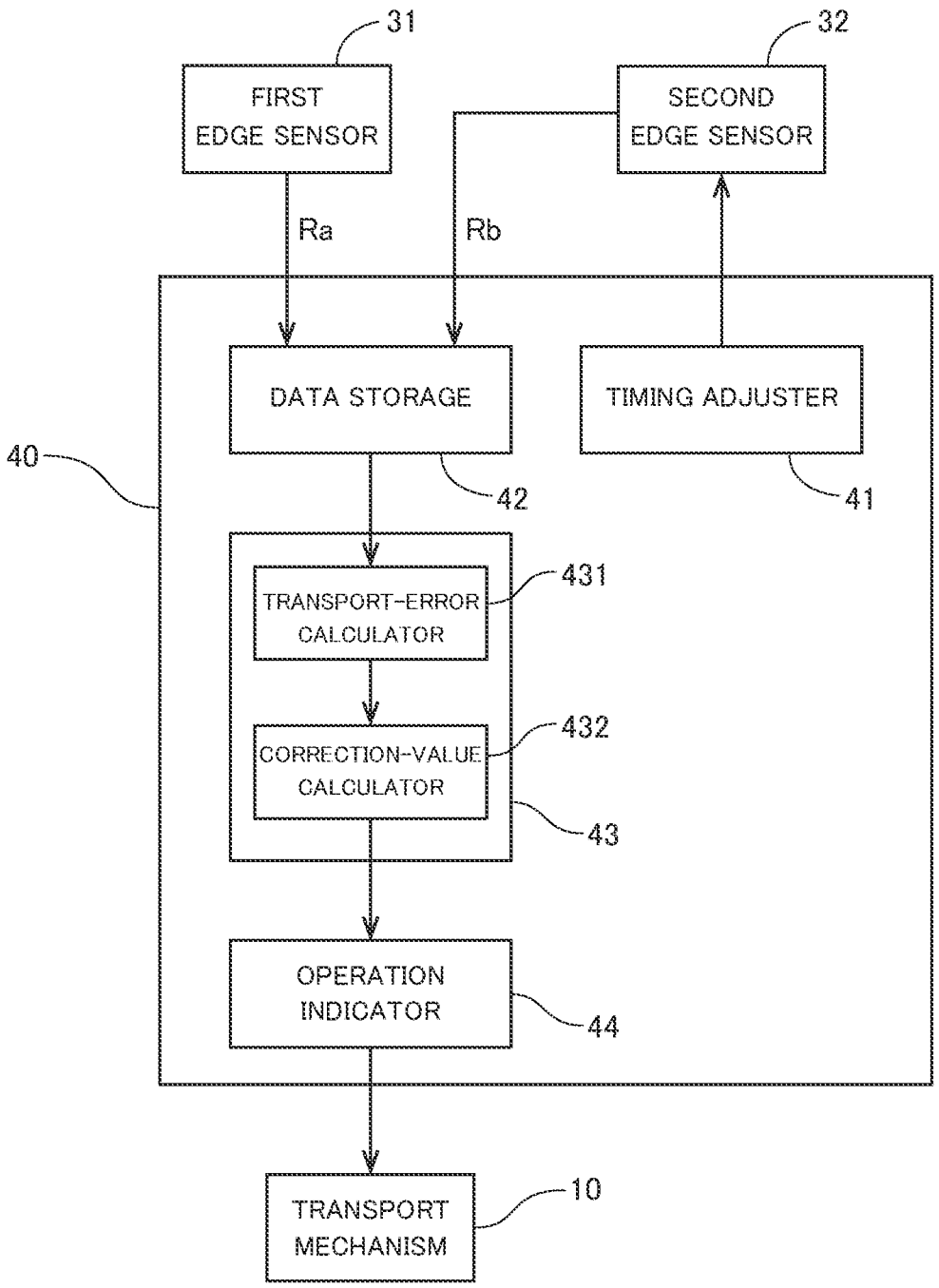
FIG. 13 is a block diagram of the controller according to a fifth variation.

FIG. 13 is a block diagram of the controller 40 according to a fifth variation. In the example illustrated in FIG. 13, the operation indicator 44 controls the operation of the transport mechanism 10, instead of the operations of the recording heads 21 to 24. In this case, the correction-value calculator 432 calculates a correction value for correcting the transport speed of the printing paper 9 transported by the transport mechanism 10, on the basis of the transport error calculated by the transport-error calculator 431. For example, if a portion of the printing paper 9 that records an image arrives behind ideal times at the first to fourth processing positions P1 to P4, the correction-value calculator 432 calculates a correction value that improves the transport speed of the printing paper 9. If a portion of the printing paper 9 that records an image arrives earlier than ideal times at the first to fourth processing positions P1 to P4, the correction-value calculator 432 calculates a correction value that reduces the transport speed of the printing paper 9. The calculated correction value is output from the correction-value calculator 432 to the operation indicator 44.

The operation indicator 44 references the correction value for the transport speed, output from the correction-value calculator 432. The operation indicator 44 then corrects the rotational speed of each roller that configures the transport mechanism 10 in accordance with the correction value. Accordingly, at each of the processing positions P1 to P4, ink droplets of each color are ejected at appropriate points in the transport direction on the printing paper 9. This suppresses mutual misalignment of the single-color images formed by each color of ink. As a result, it is possible to obtain a high-quality print image with less misregistration.

The transport mechanism 10 may include a tension adjuster that adjusts the tension of the printing paper 9 in the transport direction. For example, the tension adjuster is achieved by a pair of nip rollers arranged in part of the transport path. In that case, the operation indicator 44 may control the rotation speeds of these nip rollers while correcting the rotation speeds on the basis of the correction value.

3-6. Sixth Variation

Figure 14:
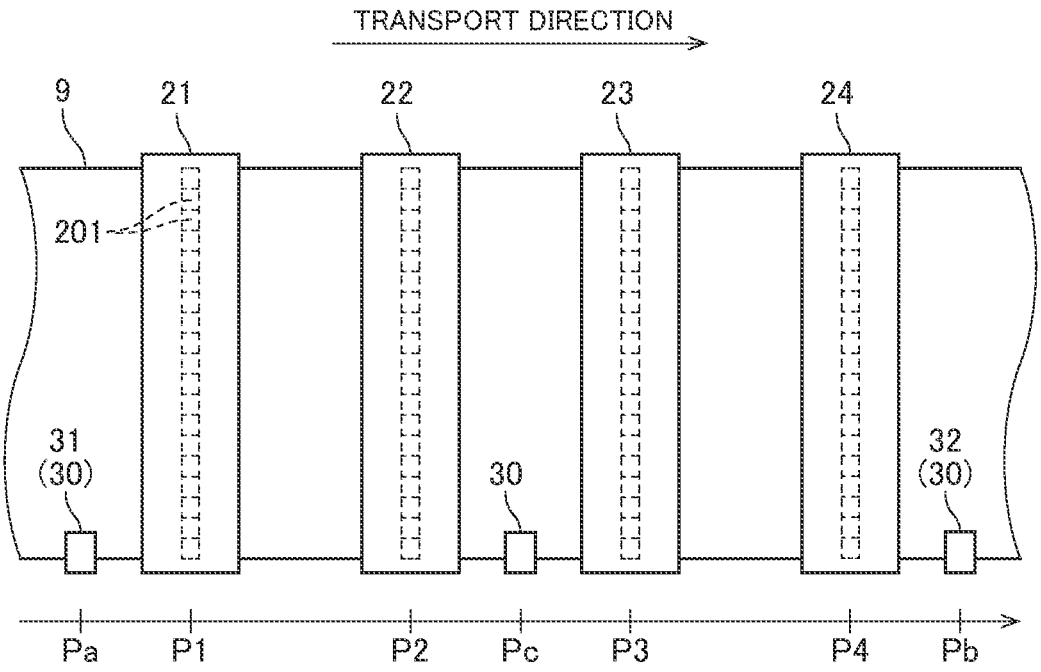
FIG. 14 is a partial top view of an image recording apparatus according to a sixth variation.

In the first embodiment described above, the edge sensors 30 are arranged at only the two positions, namely the first detection position Pa and the second detection position Pb. Alternatively, the number of edge sensors 30 arranged in the transport path of the printing paper 9 may be three or more. For example, the edge sensors 30 may be arranged at three positions, namely the first detection position Pa located upstream of the first processing position P1 in the transport path, an intermediate detection position Pc located between the second processing position P2 and the third processing position P3, and the second detection position Pb located downstream of the fourth processing position P4, as illustrated in FIG. 14.

In this case, the amount of misalignment in the transport direction of the printing paper 9 can be calculated with a higher degree of precision on the basis of the detection results obtained by the three edge sensors 30. For example, even if the amount of misalignment in the transport direction of the printing paper 9 between the first and second processing positions P1 and P2 differ from that between the third and fourth processing positions P3 and P4 due to a difference in the amount of ink adhesion, it is possible to appropriately detect the amount of misalignment at each processing position.

3-7. Other Variations

In the above-described embodiment, the edge sensors are provided on only one edge side of the printing paper in the width direction. Alternatively, edge sensors may be provided on both sides of the printing paper in the width direction. This allows the transport error of the printing paper in the transport direction to be detected on the basis of the detection results at the edges on both sides of the printing paper in the width direction. Accordingly, it is possible to further improve the precision in detecting the transport error.

The image recording apparatus may have the function of detecting the amount of misalignment (meandering) of the printing paper in the width direction on the basis of signals obtained from the edge sensors. This eliminates the need to separately provide an edge sensor for detecting the transport error of the printing paper in the transport direction and an edge sensor for detecting the amount of misalignment of the printing paper in the width direction. Accordingly, it is possible to reduce the number of parts of the image recording apparatus.

In the embodiment, the first variation, and the second variation described above, the timing adjuster 41 changes at random the time intervals of the detection timing of at least one of the first edge sensor 31 and the second edge sensor 32. In the third variation described above, the timing adjuster 41 shifts the detection timing of at least one of the first edge sensor 31 and the second edge sensor 32 along the time base while maintaining constant the time intervals of the detection timing. Alternatively, the timing adjuster 41 may perform control such that the length of the time intervals of the detection timing of at least one of the first edge sensor 31 and the second edge sensor 32 extends and contracts regularly.

In FIG. 2 described above, the recording heads 21 to 24 each have the nozzles 201 aligned in a line in the width direction. Alternatively, each of the recording heads 21 to 24 may include nozzles 201 arranged in two or more lines.

In the above-described embodiment, translucent edge sensors are used as the first and second detectors. Alternatively, the first and second detectors may use any other detection method. For example, reflective optical sensors or CCD cameras may be used. The first and second detectors may also detect the position of the edge of the printing paper two-dimensionally in both the transport direction and the width direction.

The transport time of the printing paper and the arrival time of the printing paper at each position may be measured using, for example, a clock signal or a counter. Alternatively, the transport time and the arrival time as described above may be measured using, as reference, pulse signals that are output from rotary encoders provided on the rollers of the transport mechanism.

In the above-described embodiment, the four recording heads are provided in the image recording apparatus. Alternatively, the number of recording heads in the image recording apparatus may be one, two, or three, or five or more. For example, a recording head that ejects ink of a specific color may be provided, in addition to the recording heads that eject K, C, M, and Y ink.

The present invention is not intended to eliminate the function of detecting the amount of misalignment on printing paper, using register marks or the like formed on the surface of the printing paper. For example, the result of detecting the reference image such as register marks and the result of detecting the edge with use of the edge sensors as described above may be used in combination to detect the transport error in the transport direction of the printing paper.

The image recording apparatus according to the above-described embodiment uses an inkjet system to record an image on printing paper. Alternatively, the base material processing apparatus according to the present invention may also be an apparatus that uses a method (e.g., electrophotography or exposure) other than inkjet printing to record an image on printing paper. The image recording apparatus according to the above-described embodiment is configured to perform print processing on printing paper serving as a base material. Alternatively, the base material processing apparatus according to the present invention may be configured to perform predetermined processing on a general long band-like base material (e.g., a resin film or metal foil) other than paper.

Each component according to the embodiment and the variations described above may be appropriately combined within the scope that does not cause any contradiction.

While the invention has been shown and described in detail, the foregoing description is in all aspects illustrative and not restrictive. It is therefore understood that numerous modifications and variations can be devised without departing from the scope of the invention.

REFERENCE SIGNS LIST

1 Image recording apparatus
9 Printing paper
10 Transport mechanism
11 Feed roller
12 Transport roller
13 Take-up roller
20 Image recorder
21 First recording head
22 Second recording head
23 Third recording head
24 Fourth recording head
30 Edge sensor
31 First edge sensor
32 Second edge sensor
40 Controller
41 Timing adjuster
42 Data storage
43 Arithmetic unit
44 Operation indicator
45 Driver
91 Edge
201 Nozzle
301 Projector

302 Line sensor
321 Light receiving element
400 Computer
401 Processor
402 Memory
403 Storage
404 Electric circuit
411 Clock generator
412 Counter
413 Fluctuation generator
414 Threshold-value setter
415 Comparator
431 Transport-error calculator
432 Correction-value calculator
M Degree of matching
P1 First processing position
P2 Second processing position
P3 Third processing position
P4 Fourth processing position
Pa First detection position
Pb Second detection position
Pc Intermediate detection position
Ra First detection result
Rb Second detection result

What is claimed is:

1. A base material processing apparatus comprising:

a transport mechanism that transports a long band-like base material in a longitudinal direction along a predetermined transport path;

a first detector that intermittently detects a position of an edge of the base material in a width direction at a first detection position in said transport path to acquire a first detection result that is time-series data;

a second detector that intermittently detects the position of the edge of the base material in the width direction at a second detection position located downstream of said first detection position in said transport path to acquire a second detection result that is time-series data;

a timing adjuster that changes detection timing of at least one of said first detector and the second detector by a time shorter than a standard detection period of said first detector and said second detector, wherein the at least one of said first detector and said second detector detects the position of the edge of the base material in accordance with the changed detection timing; and an arithmetic unit that calculates a transport error in a transport direction of the base material by comparison between said first detection result and said second detection result.

2. The base material processing apparatus according to claim 1, wherein said arithmetic unit executes processing for calculating a degree of matching between section data included in said first detection result and section data included in said second detection result by comparison therebetween, while changing a time in each piece of said section data, to calculate statistics of said degree of matching and calculate said transport error of the base material in accordance with said statistics.

3. The base material processing apparatus according to claim 1, wherein said timing adjuster changes at random a time interval in detection timing of at least one of said first detector and the second detector.

4. The base material processing apparatus according to claim 1, wherein said timing adjuster shifts detection timing of at least one of said first detector and the second detector while maintaining a time interval of detection timing.

5. The base material processing apparatus according to claim 1, wherein said timing adjuster changes detection timing of only one of said first detector and the second detector.

6. The base material processing apparatus according to claim 1, wherein said timing adjuster changes detection timing of both of said first detector and said second detector.

7. The base material processing apparatus according to claim 1, further comprising:

a processing unit that processes the base material at a processing position in said transport path, wherein said arithmetic unit calculates said transport error of the base material at said processing position.

8. The base material processing apparatus according to claim 7, wherein said processing position is located between said first detection position and said second detection position.

9. The base material processing apparatus according to claim 7, wherein said processing unit is an image recorder that records an image by ejecting ink on a surface of the base material.

10. The base material processing apparatus according to claim 9, wherein said arithmetic unit calculates a correction value based on said transport error calculated, and said base material processing apparatus further includes:

an operation indicator that corrects an operation of said image recorder in accordance with said correction value.

11. A detection method for detecting a transport error in a transport direction of a long band-like base material while transporting the base material in a longitudinal direction along a predetermined transport path, said detection method comprising:

a) intermittently detecting a position of an edge of the base material in a width direction at a first detection position in said transport path to acquire a first detection result that is time-series data;

b) intermittently detecting the position of the edge of the base material in the width direction at a second detection position located downstream of said first detection position in said transport path to acquire a second detection result that is time-series data;

c) changing detection timing in at least one of said step a) and said step b) by a time shorter than a standard detection period of said step a) and said step b), wherein the at least one of said step a) and said step b) detects the position of the edge of the base material in accordance with the changed detection timing; and d) calculating said transport error of the base material by comparison between said first detection result and said second detection result.

12. A base material processing apparatus comprising:

a transport mechanism that transports a long band-like base material in a longitudinal direction along a predetermined transport path;

a first detector that intermittently detects a position of an edge of the base material in a width direction at a first detection position in said transport path to acquire a first detection result that indicates a change over time in the position of the edge of the base material in the width direction at said first detection position;

a second detector that intermittently detects the position of the edge of the base material in the width direction at a second detection position located downstream of said first detection position in said transport path to acquire a second detection result that indicates a change over time in the position of the edge of the base material at said second detection position;

a timing adjuster that changes detection timing of at least one of said first detector and the second detector by a time shorter than a standard detection period of said first detector and said second detector, wherein the at least one of said first detector and said second detector detects the position of the edge of the base material in accordance with the changed detection timing; and an arithmetic unit that calculates a time difference between a time when the position of the edge of the base material is detected by said first detector and a time when the position of the edge of the base material is detected by said second detector by comparison between said first detection result and said second detection result, and calculates an actual transport time of the base material from said first detection position to said second detection position in accordance with said time difference.

13. The base material processing apparatus according to claim 12, further comprising:

a processing unit that processes the base material at a processing position in said transport path, wherein said arithmetic unit calculates an actual transport speed of the base material in said processing unit in accordance with said transport time calculated.

14. The base material processing apparatus according to claim 13, wherein said arithmetic unit calculates an arrival time when each part of the base material arrives at said processing unit, in accordance with said transport speed calculated, and calculates an amount of misregistration in said transport direction of each part of the base material in accordance with said arrival time relative to the base material is transported at an ideal transport speed.

* * * * *